US007766755B2

(12) United States Patent
Werner

(10) Patent No.: US 7,766,755 B2
(45) Date of Patent: Aug. 3, 2010

(54) SANDBOX COVER APPARATUS

(75) Inventor: James R. Werner, Cody, WY (US)

(73) Assignee: Werner Brothers, LLC, Cody, WY (US)

( * ) Notice: Subject to any disclaimer, the term of this patent is extended or adjusted under 35 U.S.C. 154(b) by 311 days.

(21) Appl. No.: 12/120,213

(22) Filed: May 13, 2008

(65) Prior Publication Data

US 2009/0283122 A1 Nov. 19, 2009

(51) Int. Cl.
*A63G 31/00* (2006.01)

(52) U.S. Cl. ..... 472/126; 135/95; 135/127

(58) Field of Classification Search ..... 472/126; 135/127, 95

See application file for complete search history.

(56) References Cited

U.S. PATENT DOCUMENTS 1,748,932 A 2/1930 Medart et al.
2,673,086 A 3/1954 Brown
2,724,123 A * 11/1955 Kesler ..... 4/513
2,851,045 A 9/1958 Haselton
3,241,157 A 3/1966 Baker et al.
4,045,019 A 8/1977 Wade
4,099,344 A * 7/1978 Ruemeli ..... 47/19.1
6,331,147 B1 12/2001 Munro et al.
7,458,898 B1 * 12/2008 Goding ..... 472/126

* cited by examiner

*Primary Examiner*—Gene Kim
*Assistant Examiner*—Michael D Dennis
(74) *Attorney, Agent, or Firm*—Antoinette M. Tease

(57) ABSTRACT

A cover for a sandbox comprising a plurality of vertical poles situated around the perimeter of the sandbox and a cover assembly. The cover assembly comprises an outer frame, inner frame, and flexible cover. The inner frame comprises a plurality of support members, which support a flexible cover and are fixedly attached to the outer frame. Each vertical pole comprises a pulley system and a vertical slot. The pulley system is connected to the outer frame with an attachment means and is fully enclosed within the vertical pole except for a portion of the attachment means. The attachment means travels up and down within the vertical slot. Each vertical pole comprises a pole cover that is slightly shorter than the vertical slot and moves laterally to expose or conceal the vertical slot.

16 Claims, 9 Drawing Sheets

SANDBOX COVER APPARATUS

BACKGROUND OF THE INVENTION

1. Field of the Invention

The present invention relates generally to the field of playground equipment, and more specifically, to a sandbox cover apparatus that can be raised and lowered to fit over a sandbox.

2. Description of the Related Art

Sandbox covers available on the market today generally consist of plastic tarps, lattices, metal screens or plywood covers that lie on top of or are fitted onto the frame of the sandbox just above ground level. These types of covers must be removed completely prior to the sandbox being used, and they are not easy to install. These prior art covers serve the purpose of keeping leaves, debris and small animals out of the sandbox, but they do not serve the purpose of providing shade to the children in the sandbox when it is in use.

What is needed is a sandbox cover that can be raised and lowered to provide shade to children inside the sandbox, that works manually and without electricity, and that has no spaces into which little fingers can be inserted, no protrusions on which little children can be hurt, and no exposed cables or pulleys. The present invention fulfills these requirements in a manner that has not been done in prior art.

BRIEF SUMMARY OF THE INVENTION

The present invention is a cover for a sandbox with a perimeter comprising: a plurality of vertical poles situated around the perimeter of the sandbox; and a cover assembly; wherein the cover assembly comprises an outer frame, an inner frame, and a flexible cover; wherein the outer frame has a perimeter, and the perimeter of the outer frame is the same shape and size as the perimeter of the sandbox; wherein the inner frame comprises a plurality of support members; wherein the support members support a flexible cover and are fixedly attached to the outer frame; wherein each vertical pole comprises a pulley system and a vertical slot; wherein the pulley system of each vertical pole is connected to the outer frame with an attachment means; wherein the pulley system is fully enclosed within the vertical pole except for a portion of the attachment means; wherein the attachment means travels up and down within the vertical slot of the vertical pole; and wherein each vertical pole comprises a pole cover that is slightly shorter than the vertical slot and that moves laterally to expose or conceal the vertical slot except for a portion of the vertical slot where the attachment means extends through the vertical slot to the outer frame.

In a preferred embodiment, the attachment means is an eyebolt, and the eyebolt comprises an eye portion that is situated inside of the vertical pole and a threaded bolt portion that is screwed into the outer frame. Preferably, the present invention further comprises a nylon washer that is installed on the eyebolt between the vertical pole and the outer frame.

In one embodiment, the flexible cover is attached to the outer frame with grommets. In an alternate embodiment, the flexible cover wraps around the inner and outer frames and is held taught by a cable and turnbuckle. Preferably, the flexible cover is comprised of nylon mesh.

In a preferred embodiment, each pole cover comprises two cutouts; wherein two stationary bolts or rivets are situated directly adjacent to each vertical slot and aligned vertically with one another; wherein one of the two bolts or rivets on each vertical pole extends through each cutout in each pole cover; wherein the cutouts are shaped such that they allow the pole cover to be moved laterally and locked in position so that they cannot be moved laterally without first moving the pole cover vertically; and wherein when the pole covers are in a locked position concealing the vertical slot, the pole covers prevent the cover assembly from being lowered when the cover assembly is in a fully raised position and prevent the cover assembly from being raised when the cover assembly is in a fully lowered position.

In a preferred embodiment, each pole comprises a top half and a bottom half, and the bolts or rivets are space apart vertically so that one bolt or rivet is in the top half of the pole and the other bolt or rivet is in the bottom half of the pole. Each pole cover preferably comprises at least one knob to facilitate lateral movement of the pole cover. Preferably, the vertical poles and pole covers are comprised of powder-coated steel.

In a preferred embodiment, each vertical pole is attached to the outer frame of the cover assembly at a single point, and the single point of attachment is where the pulley system is attached to the outer frame with the attachment means.

In a preferred embodiment, the pulley system comprises a pulley, a cable, a counterweight, and an attachment means; wherein the cable wraps around the pulley; wherein the cable comprises a first end and a second end; wherein the counterweight is attached to the first end of the cable and the attachment means is attached to the second end of the cable; and wherein the attachment means comprises a threaded portion that extends through the vertical slot and into the outer frame of the cover assembly.

In a preferred embodiment, each support member comprises a first end and a second end; wherein at least the first end of the support member is inserted into a hole drilled vertically in the outer frame; and wherein the first end of the support member is secured in the outer frame with a bolt. The outer frame is preferably comprised of aluminum.

In a preferred embodiment, the outer frame comprises a plurality of corner support members; wherein each corner support member is comprised of steel and shaped like an envelope; wherein adjoining segments of the outer frame are inserted into the corner support member; and wherein the corner support member is bolted onto the segments of the outer frame to hold the segments together. Preferably, each corner support member is welded from flat sheets of steel to form the envelope-shaped corner support member.

REFERENCE NUMBERS

Figure 1:
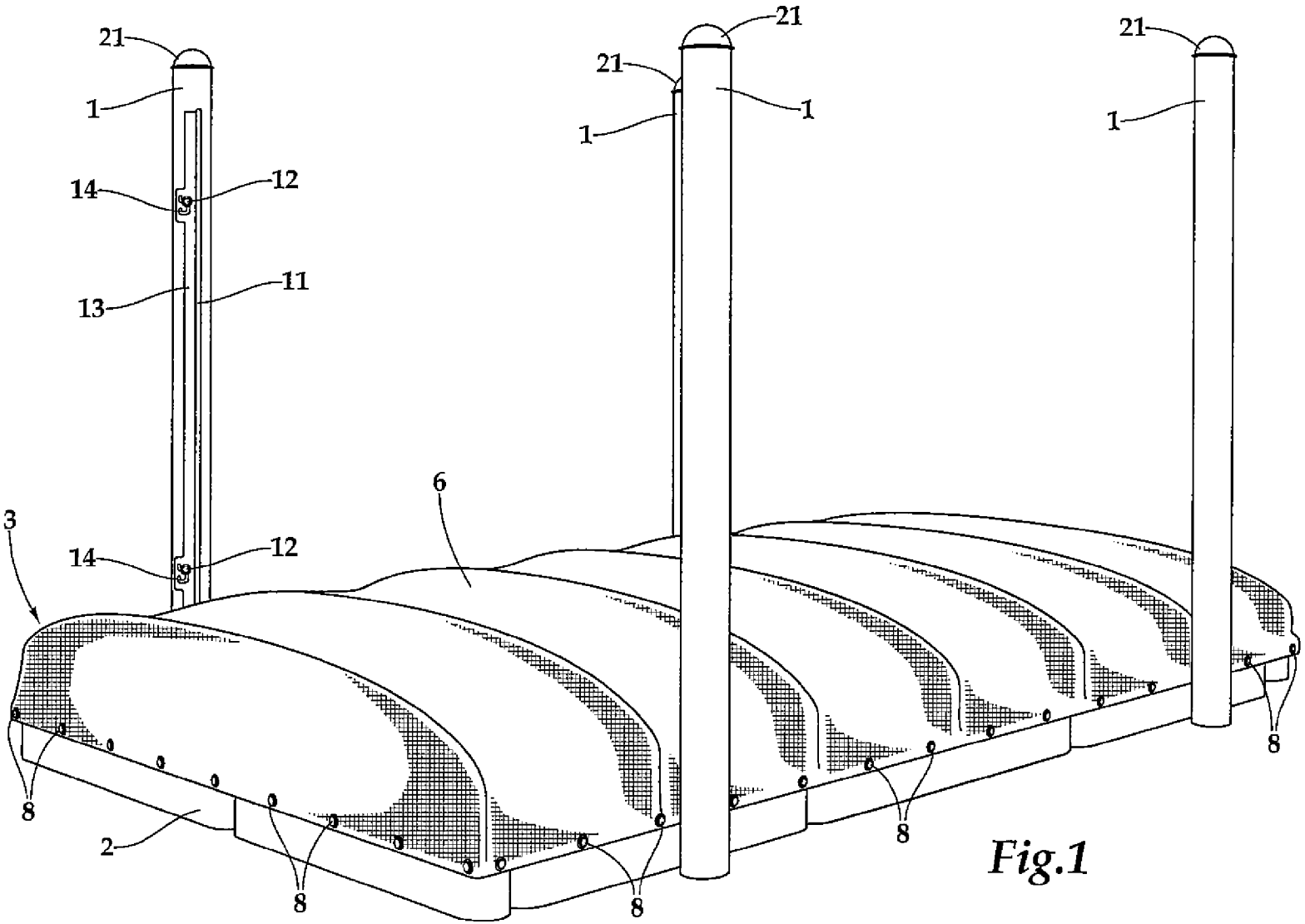
FIG. 1 is a perspective view of the present invention with the sandbox cover assembly in a fully lowered position.

1 Pole
2 Sandbox
3 Cover assembly
4 Outer frame
5 Inner frame
6 Flexible cover
7 Bow-shaped support member
8 Grommet
9 Cable (of cover assembly)
10 Turnbuckle
11 Vertical slot
12 Bolt/rivet
13 Pole cover
14 Cut-out (in pole cover)
15 Knob
16 Counterweight
17 Eyebolt
18 Pulley
19 Cable (of pulley system)
20 Axis (of pulley)
21 Removable cap (of pole)
22 Nut
23 Bolt (for holding bow-shaped support member in outer frame)
24 Corner support member
25 Central beam
26 Nylon washer
27 Aperture/hole for bow-shaped support member
28 Bolt (for securing corner support member)
29 Aperture/hole for corner support bolt
30 Support members (alternate cover assembly embodiments)
31 Segment (of outer frame)
32 Steel cone

DETAILED DESCRIPTION OF INVENTION

Figure 2:
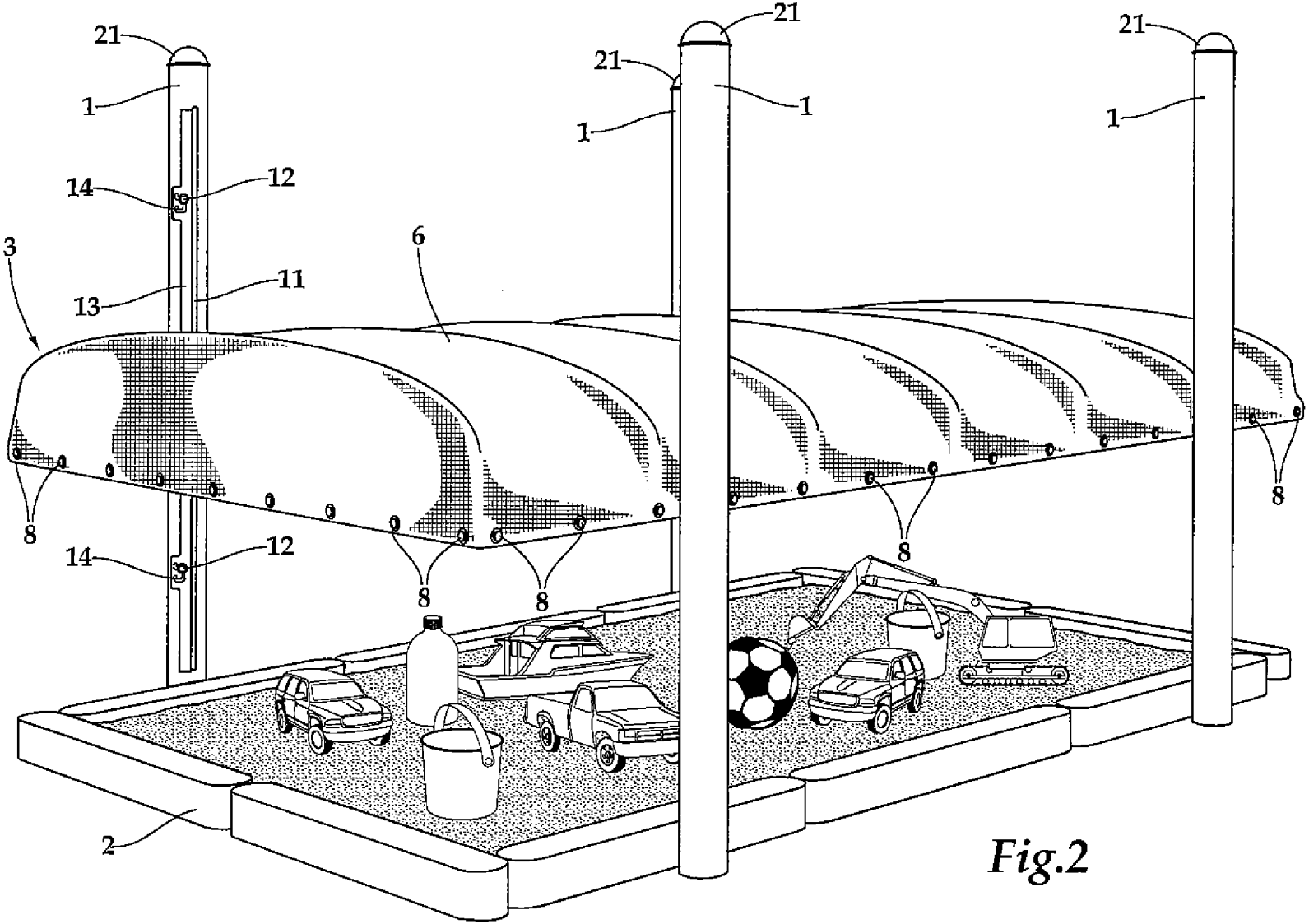
FIG. 2 is a perspective view of the present invention with the sandbox cover assembly in a middle position between fully lowered and fully raised.
Figure 3:
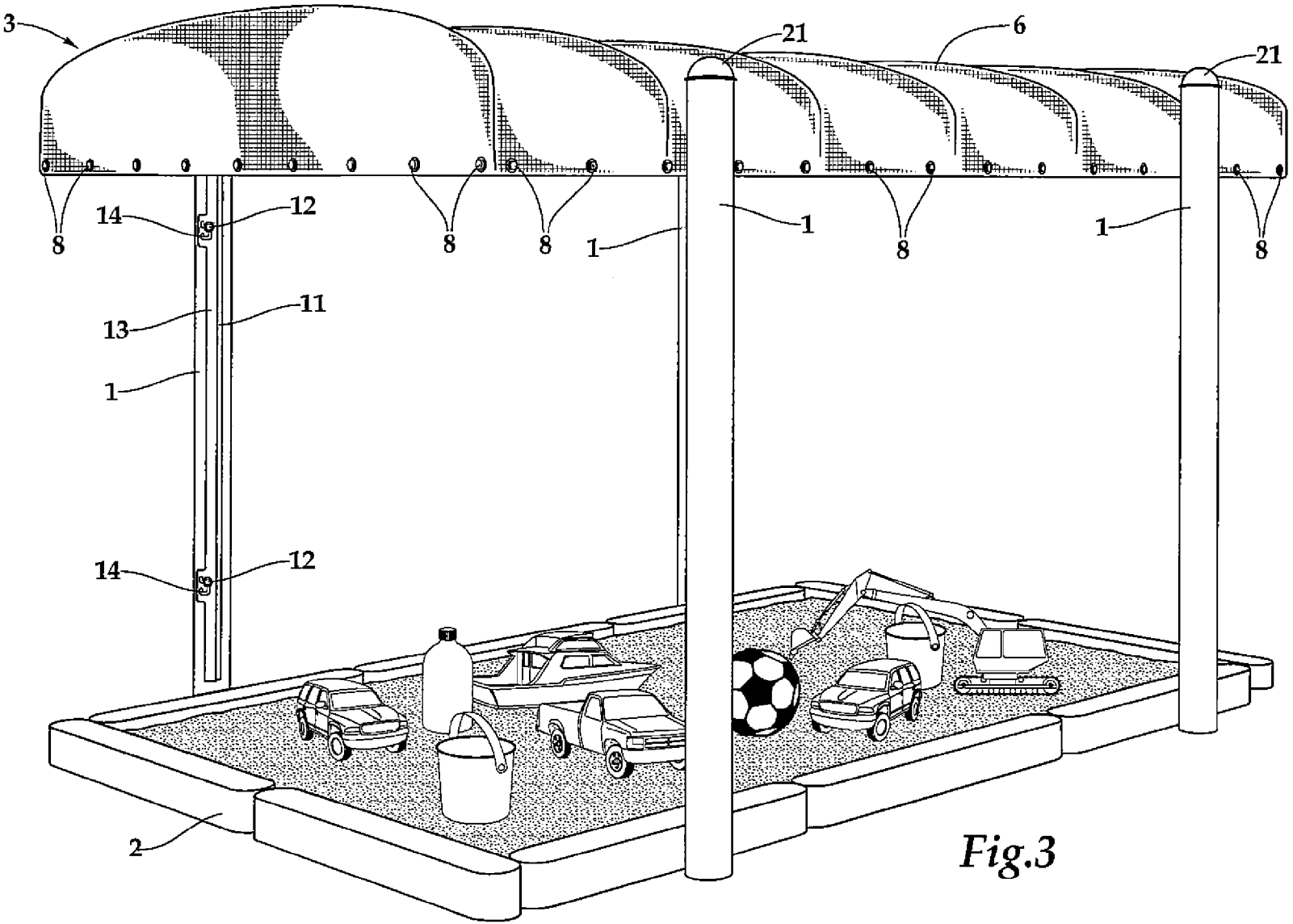
FIG. 3 is a perspective view of the present invention with the sandbox cover assembly in a fully raised position.

FIG. 1 is a perspective view of the present invention with the sandbox cover in a lowered position. As shown in this figure, the present invention comprises four poles 1, each of which encloses a pulley system (see FIGS. 8-12). The poles are set in concrete and disposed around the perimeter of an existing sandbox 2. The present invention is not limited to any particular size of sandbox, and the sandbox cover of the present invention can be configured to work with a sandbox of any shape or size. The rectangular sandbox shown in FIGS. 1-3 is by way of example and not limitation.

The present invention further comprises a cover assembly 3. The cover assembly 3 comprises an outer frame 4, an inner frame 5 (see FIGS. 15 and 16), and a flexible cover 6. The outer frame 4 is preferably the same size and configuration as the frame of the sandbox. The inner frame 5 comprises a plurality of bow-shaped support members 7 (see FIG. 15) that are attached to the outer frame 4. The flexible cover 6 is supported by the bow-shaped support members 7 and, in the embodiment shown in FIG. 1, attached to the outer frame 4 with grommets 8. In an alternate embodiment, shown in FIG. 17, the flexible cover 6 is not attached to the outer frame 4 at all but wraps around the inner and outer frames 5, 4 and is pulled taught with a cable 9 and turnbuckle 10 (the cable 9 runs inside the hem of the flexible cover 6). The turnbuckle 10 is shown in greater detail in FIG. 18. The present invention is not limited to any particular method of attaching the flexible cover 6 to (or wrapping the flexible cover 6 around) the outer frame 4.

The flexible cover 6 can be made of any durable, flexible material that will provide shade to children playing in the sandbox underneath it. One example of a suitable material is nylon mesh. In a preferred embodiment, the flexible cover 6 is comprised of COMMERCIAL 95™ Knitted Shadecloth manufactured by Gale Pacific Limited of Braeside, Victoria, Australia. This material is durable and provides resistance to ultra violet light degradation.

Each pole 1 comprises a vertical slot 11 that runs from the top end to the bottom end of the pole. Situated directly adjacent to each vertical slot 11 and aligned vertically with one another are two stationary bolts or rivets 12. The bolts/rivets 12 are preferably spaced apart vertically so that one bolt/rivet is in the top half of the pole and the other bolt/rivet is in the bottom half of the pole.

Figure 4:
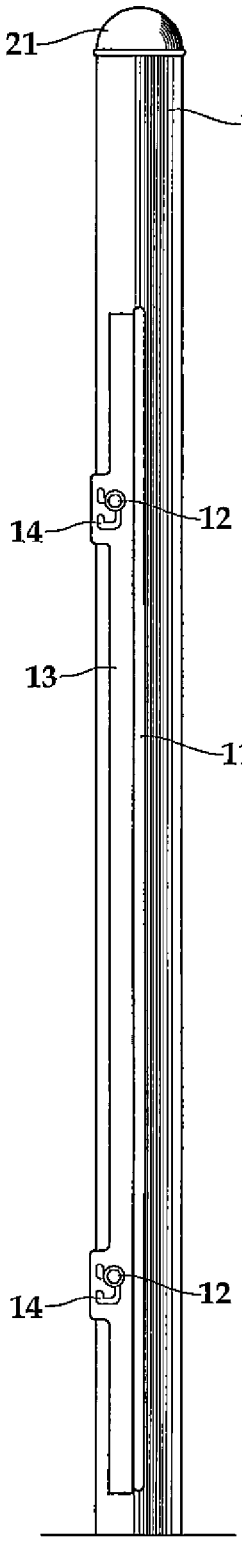
FIG. 4 is a perspective view of a pole with the pole cover in the position in which the vertical slot is exposed.
Figure 5:
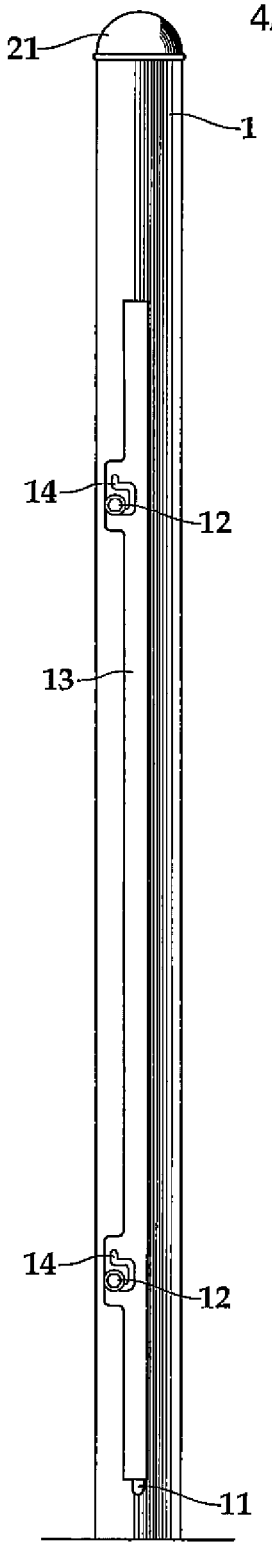
FIG. 5 is a perspective view of a pole with the pole cover in the position in which it would be if the sandbox cover assembly were in a fully lowered position.
Figure 6:
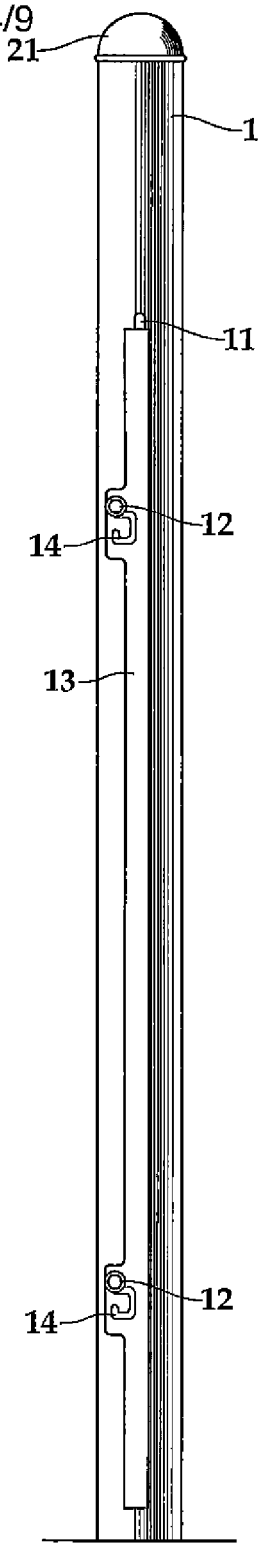
FIG. 6 is a perspective view of a pole with the pole cover in the position in which it would be if the sandbox cover assembly were in a fully raised position.
Figure 7:
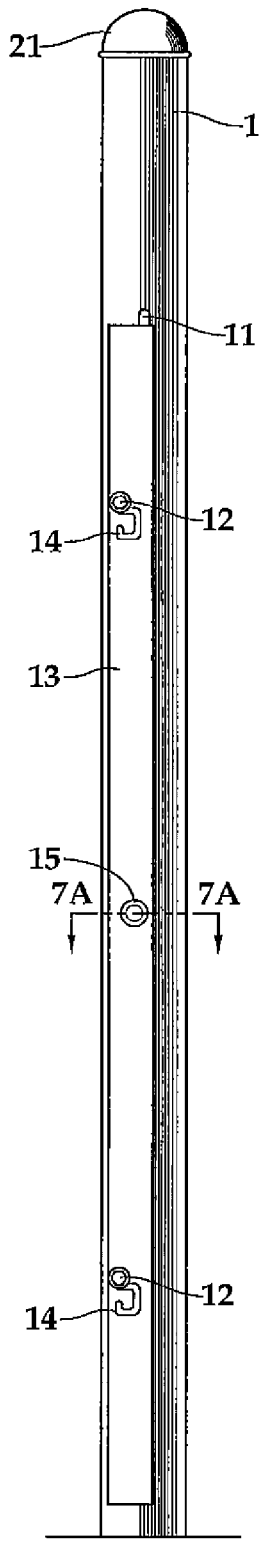
FIG. 7 is a perspective view of a pole with an alternate embodiment of the pole cover.
Figure 7A:
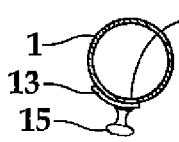

Each pole 1 further comprises a pole cover 13 that extends vertically from one end of the pole to the other and that is slightly shorter than the length of the vertical slot 11. Each pole cover 13 comprises two cut-outs 14, and a bolt/rivet 12 extends through each cut-out 14. The cut-outs 14 are preferably shaped as shown in FIGS. 4-6. The pole covers 13 can be shaped as shown in FIGS. 4-6, with the portion of the pole cover that comprises the cut-out 14 wider than the rest of the pole cover, or else the pole covers 13 can be shaped as shown in FIG. 7, with the pole cover having a single width. The former embodiment may be preferable because it requires less material to manufacture, but the latter embodiment allows for the addition of knobs 15 to facilitate moving the pole covers 13 back and forth.

In a preferred embodiment, the pole covers 13 are made of steel and powder-coated to match the poles themselves. The poles 1 are also preferably comprised of steel and powder-coated. By virtue of the cut-outs 14 and bolts/rivets 12, the pole covers 13 can be moved laterally to either expose or cover the vertical slots 11. In FIGS. 1-3, the vertical slots 11 are exposed, which is the position in which they would be to raise or lower the sandbox cover assembly 3.

The outer frame 4 of the cover assembly 3 is attached to each pole 1 at a single attachment point. These attachment points are shown in greater detail in FIGS. 8-9 and 12. The attachments points in turn are connected to a pulley system that allows the cover assembly 3 to be raised and lowered. This mechanism is described in greater detail in connection with FIGS. 8-12.

FIG. 2 is a perspective view of the present invention with the sandbox cover assembly in a middle position between fully lowered and fully raised. To raise the sandbox cover assembly 3, the outer frame 4 is manually raised, thereby causing the counterweight 16 of the pulley system to be lowered (see FIG. 9).

FIG. 3 is a perspective view of the present invention with the sandbox cover assembly in a fully raised position. To lower the sandbox cover assembly back to the position shown in FIG. 1, the outer frame 4 is manually lowered, thereby causing the counterweight 16 of the pulley system to be raised (see FIG. 8).

As shown in FIGS. 1-3, the present invention is constructed so that there are no exposed parts (the pulley system is fully enclosed inside of the poles), no openings into which little fingers might get stuck, and no protrusions on which little children might get hurt. As discussed in connection with FIGS. 4-6, the pole covers 13 are moved laterally so as to cover the vertical slot 11 when the sandbox cover assembly 3 is in a fully raised or fully lowered position.

FIGS. 4-6 are, respectively, a perspective view of a pole with the pole cover in the position in which the vertical slot is exposed, a perspective view of a pole with the pole cover in the position in which it would be if the sandbox cover assembly were in a fully lowered position, and a perspective view of a pole with the pole cover in the position in which it would be if the sandbox cover assembly were in a fully raised position. As stated above, the vertical slot 11 must be completely exposed and the pole cover 13 in the position shown in FIG. 4 in order to raise or lower the cover assembly 3.

Note that the cut-outs 14 are shaped such that when the pole covers are in the positions shown in FIG. 5 or 6 (that is, with the bolt/rivet 12 in one of the left-hand vertical notches of the cut-out), the pole covers 13 cannot be moved laterally. The pole covers must first be moved upward before they can be moved laterally. This is an additional safety feature that prevents the pole covers from being moved laterally by children.

When the cover assembly 3 is in a fully lowered position (i.e., the position shown in FIG. 1), the pole cover 13 is moved over laterally so that it fully covers the vertical slot 11 except for a small opening at the bottom of the vertical slot 11. This small opening is where the eyebolt 17 of the pulley system extends through the vertical slot and into the outer frame 4 of the cover assembly 3 (see FIG. 8). When the cover assembly 3 is in a fully raised position (i.e., the position shown in FIG. 3), the pole cover 13 is moved over laterally so that it fully covers the vertical slot 11 except for a small opening at the top of the vertical slot 11. This small opening is where the eyebolt 17 of the pulley system extends through the vertical slot and into the outer frame 4 of the cover assembly 3 (see FIG. 9). Note that the cover assembly 3 cannot be raised or lowered when the pole covers 13 are in the positions shown in FIGS. 5 and 6, which is an added safety feature.

FIGS. 8-12 illustrate the pulley system of the present invention. In these figures, the pole covers 13 shown in FIGS. 1-6 have been omitted for clarity purposes. As shown in these figures, the pulley system is comprised of a pulley 18, a cable 19, a counterweight 16 and an eyebolt 17. The counterweight 16 is attached to one end of the cable 19, and the eyebolt 17 is attached to the other end of the cable 19. The cable 19 wraps around the pulley 18.

Figure 8:
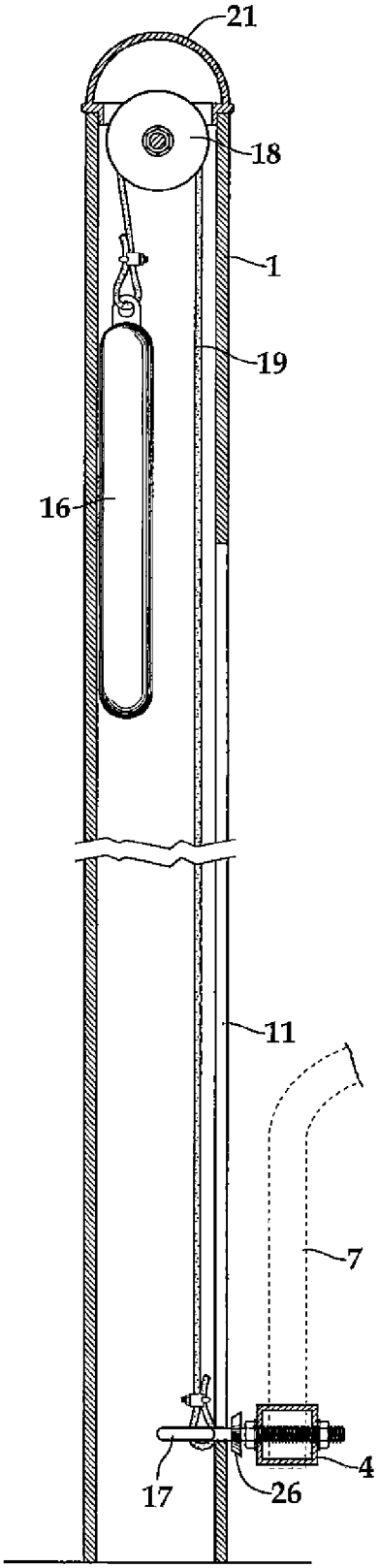
FIG. 8 is a side section view of the pulley system inside of a pole and the point at which the pulley system attaches to the outer frame of the cover assembly, shown with the cover assembly in a fully lowered position.
Figure 9:
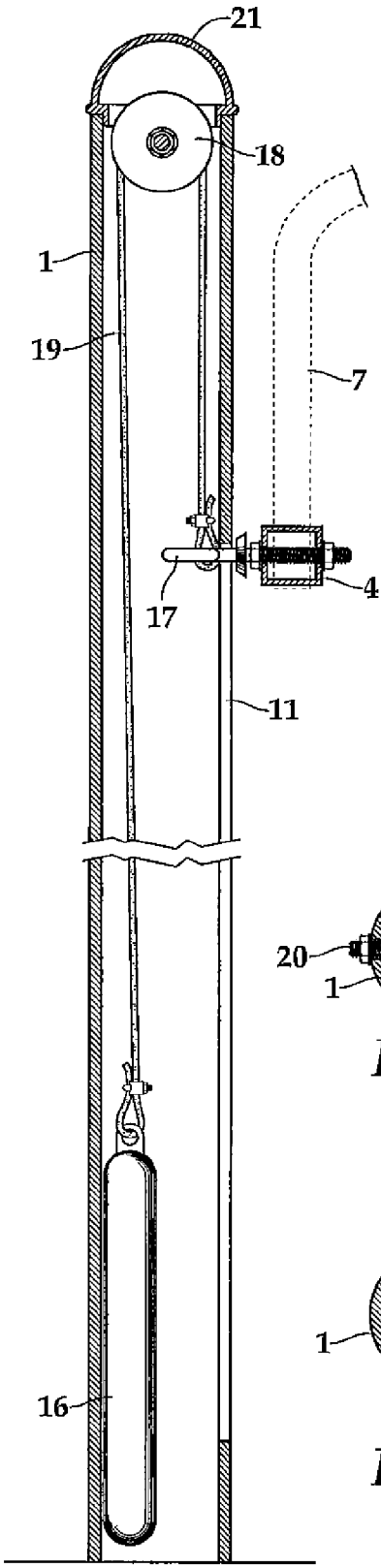
FIG. 9 is a side section view of the pulley system inside of a pole and the point at which the pulley system attached to the outer frame of the cover assembly, shown with the cover assembly in a fully raised position.
Figure 12:
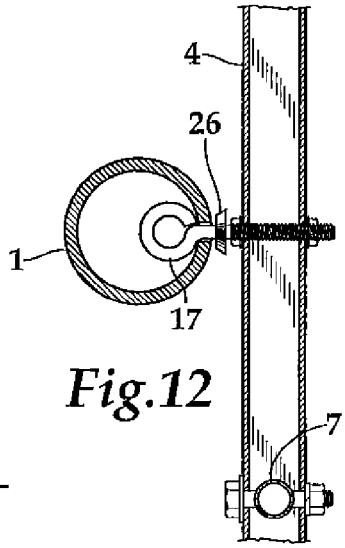
FIG. 12 is a top section view of the eyebolt in relation to the outer frame of the cover assembly.

The eyebolt 17 extends through the vertical slot 11 and into the outer frame 4 of the cover assembly 3, as shown in FIGS. 8, 9 and 12. This is the attachment point referred to above in connection with FIG. 1. The cover assembly 3 is attached to the pulley system via the eyebolt 17 at four points (one point for each pole). Optionally, a nylon washer 26 may be installed on the eyebolt between the pole 1 and the outer frame 4 to alleviate friction as the cover assembly is moved up and down.

As illustrated in FIGS. 8 and 9, the pulley system is entirely enclosed within the pole 1. At no point does the cable 19 extend outside of the pole 1, nor does any part of the pulley 18 protrude outside of the pole. Similarly, the counterweight 16 is fully contained within the pole 1, and the head of the eyebolt 17 is also contained within the pole 1. Thus, there are no exposed parts with which children could get hurt.

Figure 10:
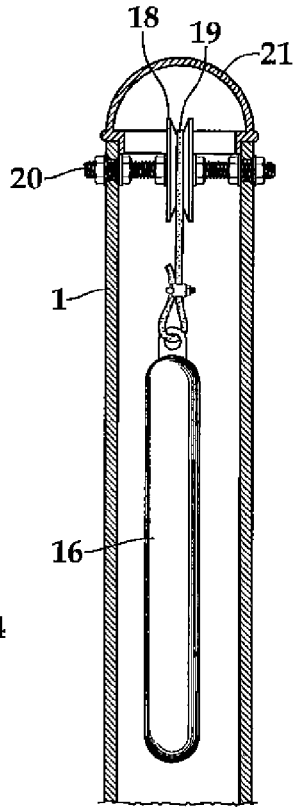
FIG. 10 is a front section view of the pulley system and counterweight shown in FIG. 8.
Figure 11:
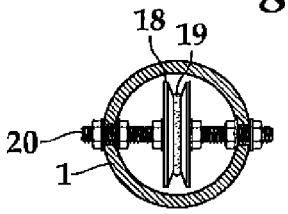
FIG. 11 is a top section view of the pulley system inside of a pole, shown without the counterweight or eyebolt for clarity.

Referring to FIG. 11, the pulley 18 is on an axis 20 that runs from one side of the pole to the other laterally. As shown in FIG. 10, the axis 20 is preferably located directly underneath the removable pole cap 21. The pole cap 21 is preferably removable so that maintenance can be performed on the pulley system if necessary.

Figure 13:
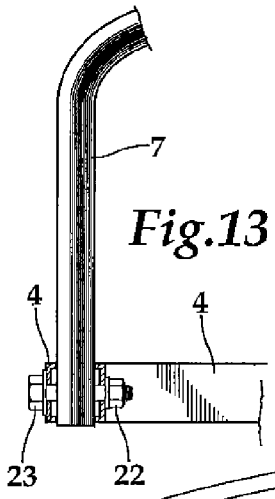
FIG. 13 is a detail view of the point at which the bow-shaped support member attaches to the outer frame of the cover assembly.

FIG. 13-16 show various aspects of the inner and outer frames of the cover assembly. FIG. 13 is a detail view of the point at which the bow-shaped support member attaches to the outer frame of the cover assembly. In a preferred embodiment, a vertical hole is drilled in the outer frame 4 at each point at which the outer frame 4 connects to a bow-shaped support member 7, and the bottom end of the bow-shaped support member 7 is inserted into the hole in the outer frame 4 and secured with a nut 22 and bolt 23. In this manner, the bow-shaped support member 7 is prevented from sliding up and down within the outer frame 4.

Figure 14:
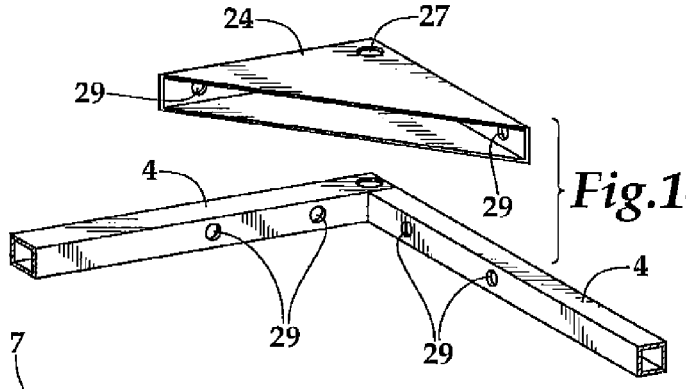
FIG. 14 is a perspective view of the corner support member of the cover assembly.
Figure 16:
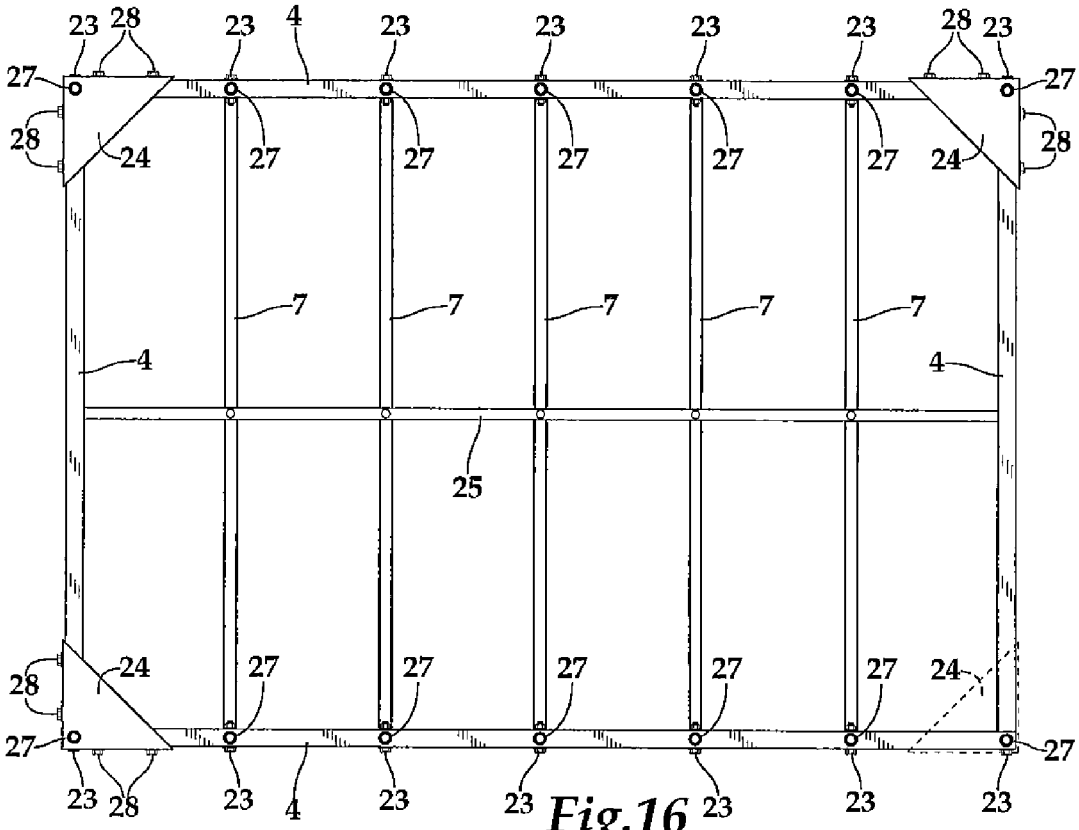
FIG. 16 is a bottom view of the inner and outer frames of the cover assembly.

FIG. 14 is a perspective view of the corner support member of the cover assembly. In a preferred embodiment, a corner support member 24 is bolted onto each of the four corners of the outer frame 4 to provide additional support and to hold the outer frame 4 together. The corner support members 24 are preferably made of steel, whereas the outer frame 4 is preferably made of aluminum to make the cover assembly 3 more lightweight and, therefore, easier to lift. In a preferred embodiment, the outer frame 4 is comprised of 1.5-inch square aluminum tubing with a ⅛-inch wall thickness. The corner support members 24 are preferably welded from flat sheets of steel to form the envelope shape shown in FIG. 14. Note that the aperture 27 shown in the corner of the corner support 24 of FIG. 14 is for the outer-most bow-shaped support member (see also FIG. 16, which shows the holes 27 in the outer frame 4 through which the ends of the bow-shaped support members 7 are inserted and secured with bolts 23). The bolts 28 that secure the corner support member to the outer frame 4 are shown in FIG. 16, and the holes 29 through which these bolts extend are shown in FIG. 14.

Figure 15:
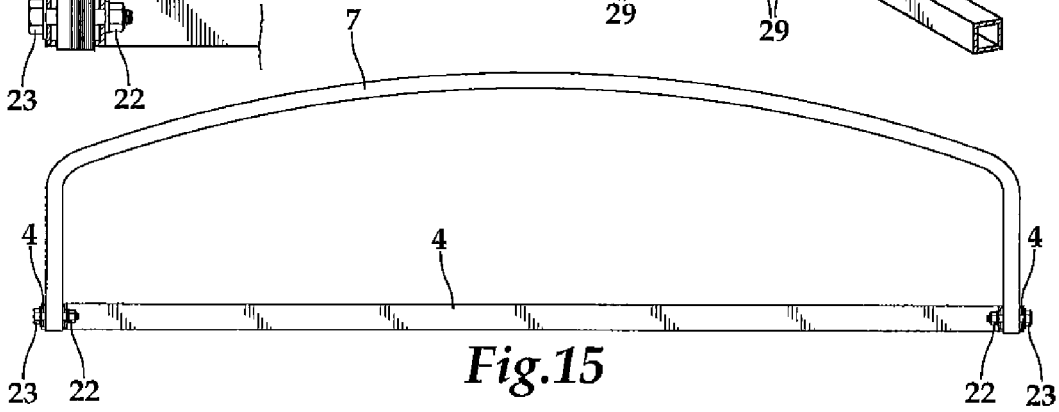
FIG. 15 is a front view of a bow-shaped support member of the inner frame of the cover assembly.

FIG. 15 is a front view of a bow-shaped support member of the inner frame of the cover assembly. In the embodiment shown in FIG. 16, there are seven bow-shaped support members 7 (the outer two bow-shaped support members are obscured in this view by the outer frame 4) in parallel alignment from one end of the cover assembly 3 to the other. The bow-shaped support members 7 comprise the inner frame 5 of the cover assembly 3. In one embodiment, the bow shaped support members are comprised of round steel tubing with an outer diameter of approximately 11/16 inch. A central beam 25, also made of steel, runs perpendicular to the bow-shaped cross-members 7 and is preferably attached to each bow-shaped cross-member with a nut and bolt. The central beam 25 may be comprised of a single piece of steel tubing or of multiple, interconnected pieces of steel tubing. The purpose of the central beam 25 is to prevent the bow-shaped cross-members from leaning sideways.

The present invention is not limited to the particular shape or configuration of the cover assembly shown in FIGS. 1-3 and 15-17. The present invention can be built to accommodate any sandbox shape, and the specific configuration of the cover assembly can be varied to accommodate different sandbox shapes and sizes. Two alternate cover configurations are shown in FIGS. 19-23. The similarities among all of these cover assembly designs is that the support members 30 attach to the outer frame 4 in the same manner in which the bow-shaped cross-members attach to the outer frame 4, as shown in FIGS. 8 and 9. Moreover, the poles 1, which are positioned around the perimeter of the sandbox 2, are attached to the outer frame 4 in the same manner as that shown in connection with FIGS. 8, 9, 12 and 13. In the embodiments shown in FIGS. 19-23, the support members 30 are preferably comprised of round steel tubing with an outer diameter of approximately 11/16 inch.

The outer frame 4 of the embodiments shown in FIGS. 19-23 is preferably comprised of aluminum, and these particular embodiments may be constructed with or without corner support members 24 (see FIG. 14) for added support at the joints. If corner support members 24 are not used, then each segment 31 of the outer frame 5 is either bolted or welded to the adjacent segments of the outer frame. The embodiment shown in FIGS. 19-20 comprises a steel cone 32 at the top of the inner frame where the support member 30 come together; the support members 30 are preferably bolted or otherwise fixedly attached to the steel cone 32. The embodiment shown in FIGS. 21-23 comprises a central beam 25 to which the support members 30 are attached.

Figure 17:
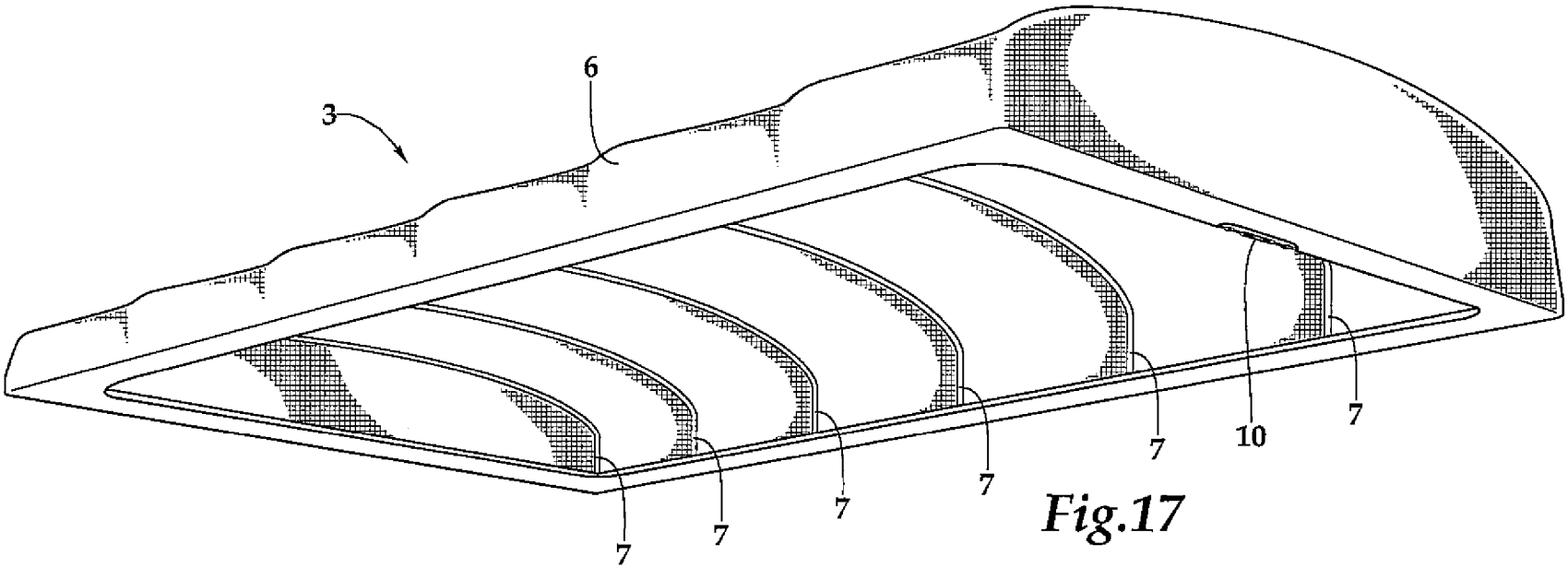
FIG. 17 is a perspective view of an alternate embodiment of the flexible cover of the cover assembly.
Figure 18:
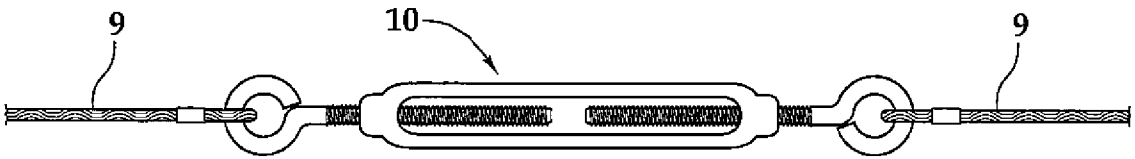
FIG. 18 is a detail view of the turnbuckle shown in FIG. 17.
Figure 19:
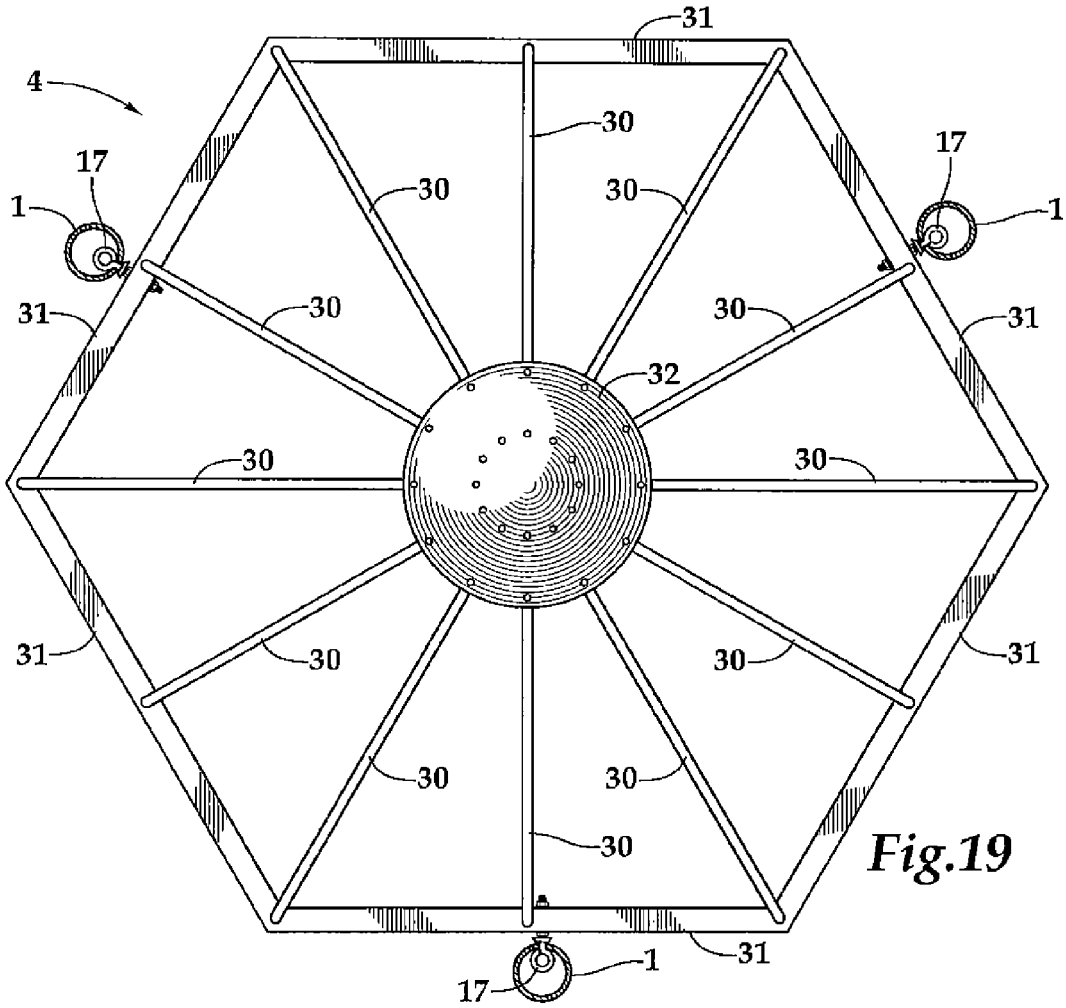
FIG. 19 is a top view of a first alternate embodiment of the cover assembly.
Figure 20:
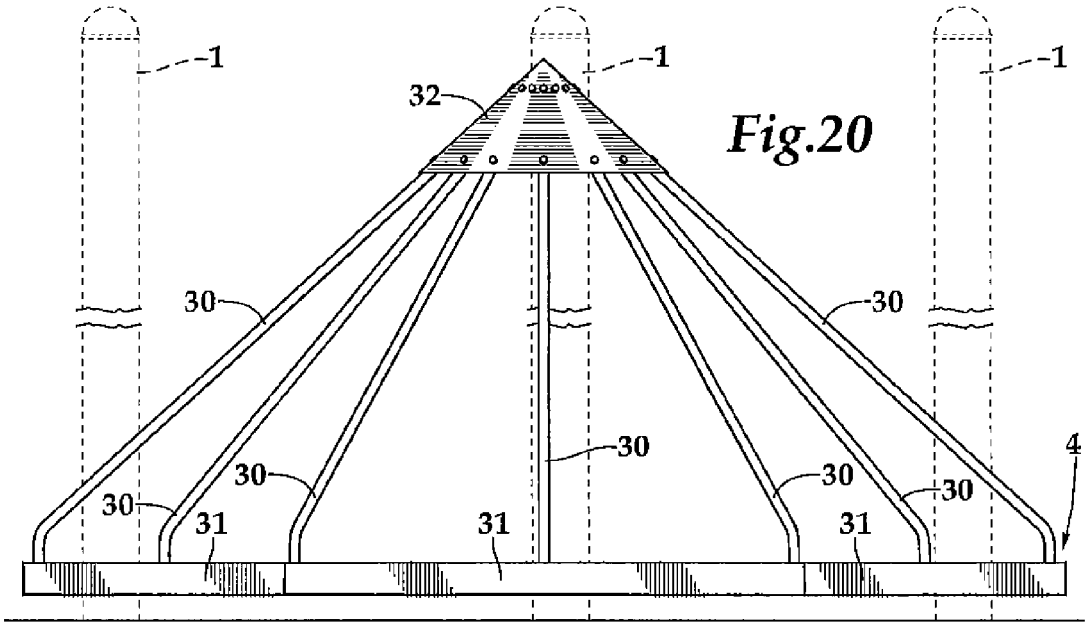
FIG. 20 is a side view of a first alternate embodiment of the cover assembly.
Figure 21:
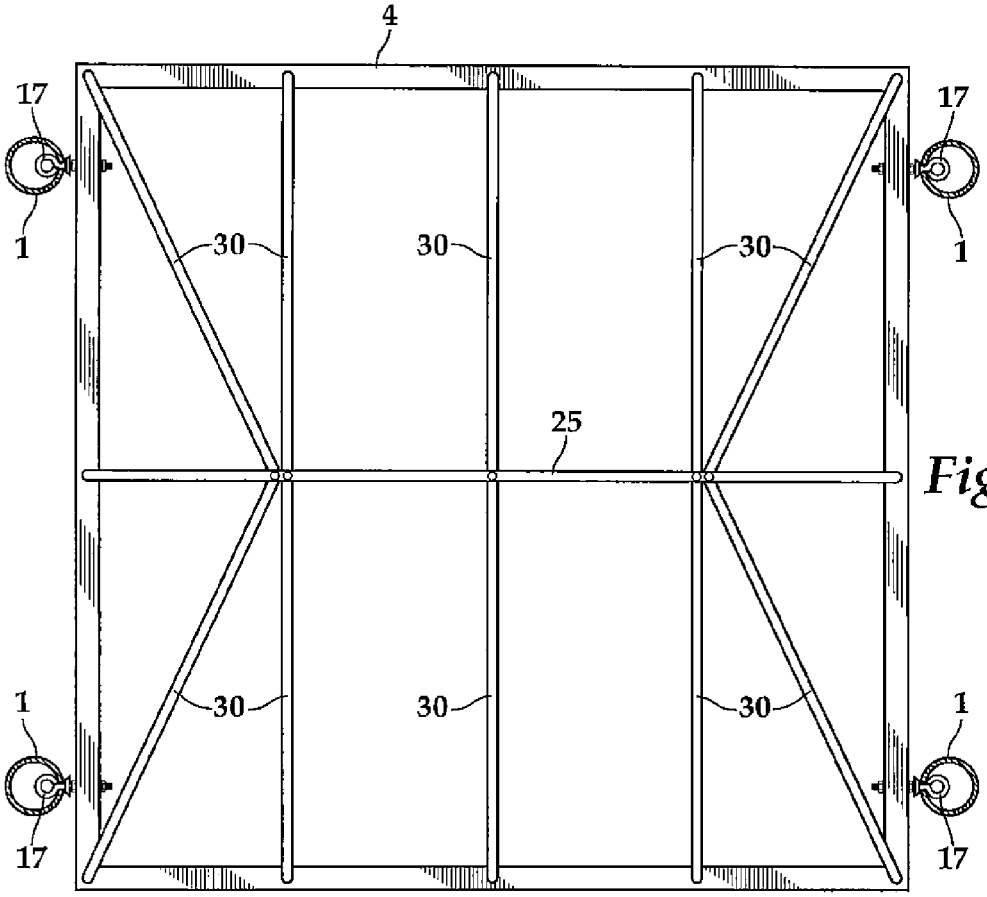
FIG. 21 is a top view of a second alternate embodiment of the cover assembly.
Figure 22:
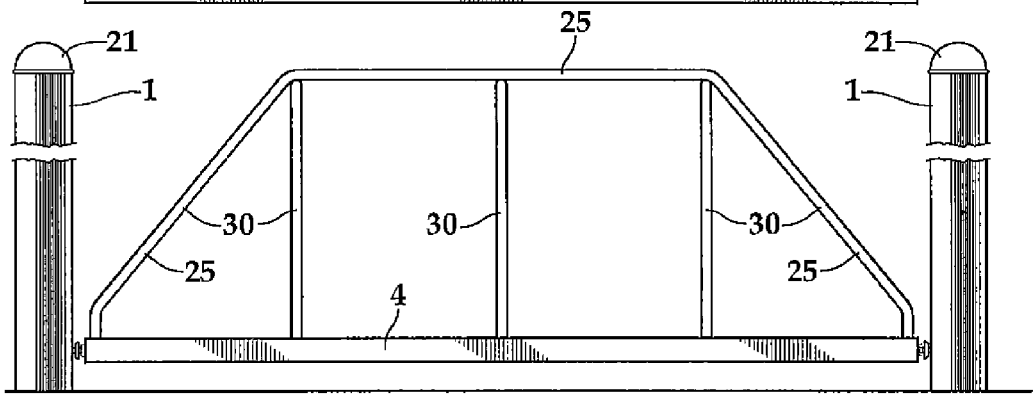
FIG. 22 is an end view of a second alternate embodiment of the cover assembly.
Figure 23:
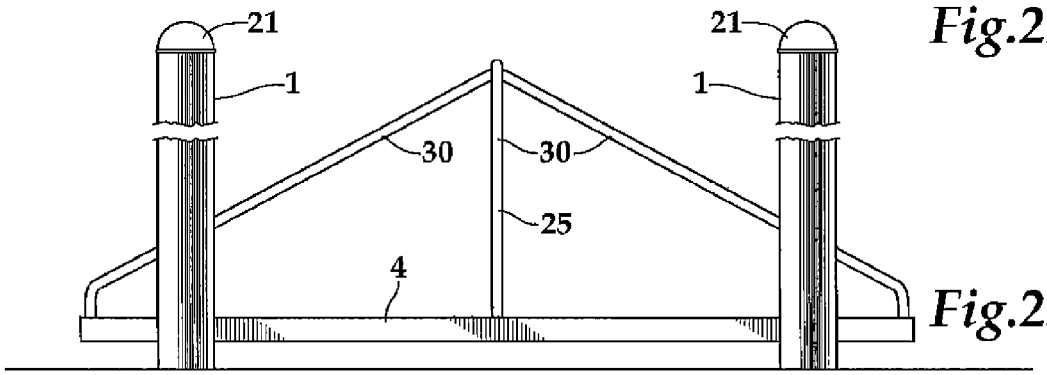
FIG. 23 is a side view of a second alternate embodiment of the cover assembly.

The flexible cover 6 is omitted from FIGS. 19-23 for clarity but is preferably either attached to the outer frame 4 with grommets 8, as shown in FIGS. 1-3, or wrapped around the inner and outer frames, as shown in FIG. 17. The present invention is not limited to any particular method of attaching the flexible cover to the inner and outer frames, however.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A cover for a sandbox with a perimeter comprising:

(a) a plurality of vertical poles situated around the perimeter of the sandbox; and (b) a cover assembly;

wherein the cover assembly comprises an outer frame, an inner frame, and a flexible cover;

wherein the outer frame has a perimeter, and the perimeter of the outer frame is the same shape and size as the perimeter of the sandbox;

wherein the inner frame comprises a plurality of support members;

wherein the support members support a flexible cover and are fixedly attached to the outer frame;

wherein each vertical pole comprises a pulley system and a vertical slot;

wherein the pulley system of each vertical pole is connected to the outer frame with an attachment means;

wherein the pulley system is fully enclosed within the vertical pole except for a portion of the attachment means;

wherein the attachment means travels up and down within the vertical slot of the vertical pole; and wherein each vertical pole comprises a pole cover that is slightly shorter than the vertical slot and that moves laterally to expose or conceal the vertical slot except for a portion of the vertical slot where the attachment means extends through the vertical slot to the outer frame.

2. The sandbox cover of claim 1, wherein the attachment means is an eyebolt; and wherein the eyebolt comprises an eye portion that is situated inside of the vertical pole and a threaded bolt portion that is screwed into the outer frame.

3. The sandbox cover of claim 2, further comprising a nylon washer that is installed on the eyebolt between the vertical pole and the outer frame.

4. The sandbox cover of claim 1, wherein the flexible cover is attached to the outer frame with grommets.

5. The sandbox cover of claim 1, wherein the flexible cover wraps around the inner and outer frames and is held taught by a cable and turnbuckle.

6. The sandbox cover of claim 1, wherein the flexible cover is comprised of nylon mesh.

7. The sandbox cover of claim 1, wherein each pole cover comprises two cutouts;

wherein two stationary bolts or rivets are situated directly adjacent to each vertical slot and aligned vertically with one another;

wherein one of the two bolts or rivets on each vertical pole extends through each cutout in each pole cover;

wherein the cutouts are shaped such that they allow the pole cover to be moved laterally and locked in position so that they cannot be moved laterally without first moving the pole cover vertically; and wherein when the pole covers are in a locked position concealing the vertical slot, the pole covers prevent the cover assembly from being lowered when the cover assembly is in a fully raised position and prevent the cover assembly from being raised when the cover assembly is in a fully lowered position.

8. The sandbox cover of claim 1, wherein each pole comprises a top half and a bottom half; and wherein the bolts or rivets are space apart vertically so that one bolt or rivet is in the top half of the pole and the other bolt or rivet is in the bottom half of the pole.

9. The sandbox cover of claim 1, wherein each pole cover comprises at least one knob to facilitate lateral movement of the pole cover.

10. The sandbox cover of claim 1, wherein the vertical poles and pole covers are comprised of powder-coated steel.

11. The sandbox cover of claim 1, wherein each vertical pole is attached to the outer frame of the cover assembly at a single point; and wherein the single point of attachment is where the pulley system is attached to the outer frame with the attachment means.

12. The sandbox cover of claim 1, wherein the pulley system comprises a pulley, a cable, a counterweight, and an attachment means;

wherein the cable wraps around the pulley;

wherein the cable comprises a first end and a second end;

wherein the counterweight is attached to the first end of the cable and the attachment means is attached to the second end of the cable; and wherein the attachment means comprises a threaded portion that extends through the vertical slot and into the outer frame of the cover assembly.

13. The sandbox cover of claim 1, wherein each support member comprises a first end and a second end;

wherein at least the first end of the support member is inserted into a hole drilled vertically in the outer frame; and wherein the first end of the support member is secured in the outer frame with a bolt.

14. The sandbox cover of claim 1, wherein the outer frame is comprised of aluminum.

15. The sandbox cover of claim 1, wherein the outer frame comprises a plurality of corner support members;

wherein each corner support member is comprised of steel and shaped like an envelope;

wherein adjoining segments of the outer frame are inserted into the corner support member; and wherein the corner support member is bolted onto the segments of the outer frame to hold the segments together.

16. The sandbox cover of claim 1, wherein each corner support member is welded from flat sheets of steel to form the envelope-shaped corner support member.

* * * * *